United States Patent [19]

Welsby

[11] Patent Number: 4,835,881

[45] Date of Patent: Jun. 6, 1989

[54] DRYER SECTION APPARATUS

[75] Inventor: John Welsby, Shevington, England

[73] Assignee: Beloit Corporation, Beloit, Wis.

[21] Appl. No.: 110,405

[22] Filed: Oct. 19, 1987

[30] Foreign Application Priority Data

Jul. 23, 1987 [GB] United Kingdom ..... 8717387

[51] Int. Cl.[4] ..... A26B 25/00

[52] U.S. Cl. ..... 34/117; 34/114

[58] Field of Search ..... 34/110, 111, 116, 117, 34/120, 123, 243

[56] References Cited

U.S. PATENT DOCUMENTS

| | | | |
|---|---|---|---|
| 3,316,657 | 5/1967 | Haywood | 34/116 |
| 3,448,529 | 6/1969 | Erspamer et al. | 34/116 |
| 3,868,780 | 3/1975 | Soininen et al. | 34/117 |
| 4,483,083 | 11/1984 | Chance | 34/116 |

*Primary Examiner*—Henry A. Bennet

*Attorney, Agent, or Firm*—Dirk J. Veneman; Raymond W. Campbell; David J. Archer

[57] ABSTRACT

A dryer section apparatus is disclosed for drying a web extending therethrough. The apparatus includes a plurality of lower dryer drums and a plurality of upper dryer drums. A lower felt partially wraps each lower dryer drum of the plurality of lower dryer drums and each lower intermediate roll of a plurality of lower intermediate rolls is disposed between adjacent lower dryer drums such that each alternate lower intermediate roll guides both the web and the lower felt. An upper felt partially wraps each of the upper dryer drums of the plurality of upper dryer drums. The apparatus also includes a plurality of upper intermediate rolls with each upper intermediate roll being disposed between adjacent upper dryer drums such that each alternate upper intermediate roll guides both the web and the felt so that the web is transferred in open draw between adjacent upper and lower dryer drums thereby minimizing the length of the open draw and inhibiting web flutter during transfer between upper and lower dryer drums.

13 Claims, 3 Drawing Sheets

DRYER SECTION APPARATUS

BACKGROUND OF THE INVENTION

1. Field of the Invention

This invention relates to a dryer section apparatus for drying a web extending therethrough. More particularly, the present invention relates to an apparatus having a plurality of lower dryer drums and a plurality of upper dryer drums.

2. Information Disclosure Statement

When a formed web of paper emerges from a press section of a papermaking machine, the formed web still contains a large percentage of water therein. Much of this water is removed from the formed web during passage of the web through a drying section of the papermaking machine. Such dryer section usually includes a plurality of heated dryer drums over which the formed web extends. As the web is brought into intimate contact with the heated outer surface of the dryer drums, the web is heated so that at least a portion of the moisture contained therein is removed from the web.

The so-called "uni run" or "uno run" dryer sections typically include an upper and a lower tier of dryer drums. Each upper and lower tier comprise a plurality of heated, rotatable dryer drums. A felt extends in sinusoidal configuration alternately between dryer drums of the upper and lower tiers and the web is pressed into physical contact with the heated surface of each alternate dryer drum during passage through the dryer section. Although the aforementioned system provides support for the web by the felt during passage through the dryer section, such prior art systems suffer from the following disadvantages.

First, the web is brought into physical contact with only each alternate heated dryer drum during passage through the dryer section because each alternate dryer drum includes the supporting felt disposed between the heated surface of the dryer drum and the web. Secondly, as the web extends around the dryer drum with the felt disposed between the web and the heated surface of the dryer drum, there existed the tendency for the web to be thrown by centrifigal force and for the web to be detached from the felt due to the wedge of air pressure at the ingoing nip.

The present invention overcomes the aforementioned problems associated with the prior art arrangement by the provision of a unique configuration of upper and lower dryer drums. Unlike the prior art "uni run" system, the present invention provides a separate upper and lower felt with the upper felt extending alternately around an upper dryer drum and an upper intermediate roll in sinusoidal configuration. Similarly, the lower felt extends alternately between each lower dryer drum and a lower intermediate roll. The arrangement is such that each alternate intermediate roll of both the upper and lower intermediate rolls are wrapped by both the felt and the web. By such arrangement, the web extends in open draw between each adjacent upper and lower dryer drum so that the web passes in intimate contact with the heated surface of each upper and lower dryer drum. Furthermore, because of the aforementioned unique configuration, the unsupported distance travelled by the web between adjacent upper and lower dryer drums is kept to a minimum.

Therefore, the primary objective of the present invention is to provide a dryer section apparatus which overcomes the aforementioned inadequacies of the prior art devices and provides an apparatus which not only enables the formed web to come into intimate contact with the heated surface of each dryer drum, but also minimizes the open draw between adjacent upper and lower dryer drums.

Another object of the present invention is the provision of a dryer section apparatus in which each lower intermediate roll is disposed between adjacent lower dryer drums such that each alternate lower intermediate roll guides both the web and the lower felt.

Another object of the present invention is the provision of a dryer section apparatus in which each upper intermediate roll of a plurality of upper intermediate rolls is disposed between adjacent upper dryer drums such that each alternate upper intermediate roll guides both the web and the felt so that the web is transferred in open draw between adjacent upper and lower dryer drums, thereby minimizing the length of the open draw and inhibiting web flutter during transfer between upper and lower dryer drums.

Another object of the present invention is the provision of a dryer section apparatus in which the upper and lower intermediate rolls are vacuum rolls.

Another object of the present invention is the provision of a dryer section apparatus in which each of the upper and lower intermediate rolls is a grooved roll.

Another object of the present invention is the provision of a dryer section apparatus in which each lower intermediate roll which guides both the web and the felt is disposed at a first distance relative to the upper intermediate roll which is partially wrapped by only the upper felt. Each of the lower intermediate rolls which are partially wrapped by the lower felt only are disposed a second distance relative to the adjacent upper intermediate roll partially wrapped by both the web and the upper felt and the second distance is the same as, or greater than the first distance.

Another object of the present invention is the provision of a dryer section apparatus in which each intermediate roll which is partially wrapped by the felt and the web defines a pocket, a blow box being disposed within each of the pockets for ventilating each pocket and for removing boundary air entering into the pocket.

Another object of the present invention is the provision of a dryer section apparatus including a plurality of doctor blades with each blade cooperating with a corresponding dryer drum of the upper and lower dryer drums such that each blade contacts an unwrapped surface of each respective drum.

Another object of the present invention is the provision of a dryer section apparatus in which the doctor blades assist in stabilizing the web by restricting the influence of external air flow. The blades also assist in directing a tail of the web during threading of the apparatus without the use of ropes.

Another object of the present invention is the provision of a dryer section apparatus including a duct which is disposed adjacent to each lower intermediate roll which is partially wrapped only by the lower felt. The duct blows air through the lower felt for ventilating the adjacent dryer pocket defined between the upper and lower felts.

Another object of the present invention is the provision of a dryer section apparatus which includes ventilating means disposed adjacent to each upper intermediate roll partially wrapped only by the upper felt, the ventilating means blowing air through the upper felt for ventilating air from an adjacent dryer pocket defined between the upper and lower felts.

Other objects and advantages of the present invention will be evident to those skilled in the art by consideration of the detailed description contained hereinafter taken in conjunction with the annexed drawings.

SUMMARY OF THE INVENTION

The present invention relates to a dryer section apparatus and a method for drying a web extending therethrough. The apparatus includes a plurality of lower dryer drums and a plurality of upper dryer drums. The apparatus includes a lower felt which partially wraps each of the lower dryer drums of the plurality of lower dryer drums. The apparatus also includes a plurality of lower intermediate rolls with each lower intermediate roll being disposed between adjacent lower dryer drums such that each alternate lower intermediate roll guides both the web and the lower felt. An upper felt partially wraps each upper dryer drum of the plurality of upper dryer drums. The apparatus includes a plurality of upper intermediate rolls with each upper intermediate roll being disposed between adjacent upper dryer drums such that each alternate upper intermediate roll guides both the web and the upper felt so that the web is transferred in open draw between adjacent upper and lower dryer drums thereby minimizing the length of the open draw and inhibiting web flutter during transfer between upper and lower dryer drums.

In a more specific embodiment of the present invention, the lower felt presses the web into physical contact with the lower dryer drums such that when the lower dryer drums are heated, the web pressed against the lower drums is dried. The lower felt extends in sinusoidal configuration between each adjacent lower dryer drum and each lower intermediate roll. Each alternate lower intermediate roll which guides both the web and the lower felt is disposed adjacent to an upper intermediate roll which is partially wrapped by only the upper felt. Each of the alternate lower intermediate rolls is a vacuum roll.

Each of the lower intermediate rolls which guides both the web and the lower felt is disposed at a first distance relative to the upper intermediate roll which is partially wrapped by only the upper felt. Each of the lower intermediate rolls which are partially wrapped by the lower felt only is disposed a second distance relative to an adjacent upper intermediate roll partially wrapped by both the web and the upper felt. The arrangement is such that the second distance is the same as, or greater than the first distance.

Each lower intermediate roll which is partially wrapped by the lower felt and the web and each upper intermediate roll which is partially wrapped by the upper felt and the web defines a pocket. A blow box is disposed within each of these pockets for ventilating each of the pockets and for removing boundary air entering into the pockets.

The upper felt presses the web into physical contact with the upper dryer drums such that when the upper dryer drums are heated, the web pressed against the upper dryer drums is dried. The upper felt extends in sinusoidal configuration between each adjacent upper dryer drum and upper intermediate roll.

Each alternate upper intermediate roll which guides both the web and the upper felt is disposed adjacent to a lower intermediate roll which is partially wrapped by only the lower felt and each alternate upper roll is a vacuum roll.

The apparatus also includes a plurality of doctor blades with each blade cooperating with a corresponding dryer drum of the upper and lower dryer drums such that each blade contacts an unwrapped surface of each respective drum. The blades not only assist in stabilizing the web by restricting the influence of external air flows but also assist in directing a tail of the web during threading of the apparatus without the use of ropes.

A duct is disposed adjacent to each lower intermediate roll partially wrapped only by the lower felt. The duct blows air through the lower felt for ventilating an adjacent dryer pocket defined between the upper and the lower felts.

Ventilating means are disposed adjacent to each upper intermediate roll partially wrapped only by the upper felt. The ventilating means blows air through the upper felt for ventilating air from an adjacent dryer pocket defined between the upper and lower felts.

In an alternative embodiment of the present invention, the vacuum rolls are replaced by grooved rolls.

Although the present invention as described in the detailed description teaches intermediate rolls which are vacuum rolls, or grooved rolls, the present invention is not limited to the use of such rolls but includes pocket ventilation rolls, vented rolls, partially grooved rolls or the like. Although the present invention is described with certain particularity in the detailed description hereinafter, it will be appreciated by those skilled in the art that many modifications and variations of the basic concept of the present invention can be made without departing from the spirit and scope of the present invention as defined by the appended claims and that such variations and modifications fall within the scope of the present invention.

BRIEF DESCRIPTION OF THE DRAWINGS

Similar reference characters refer to similar parts throughout the various figures.

DETAILED DESCRIPTION OF THE DRAWINGS

Figure 1:
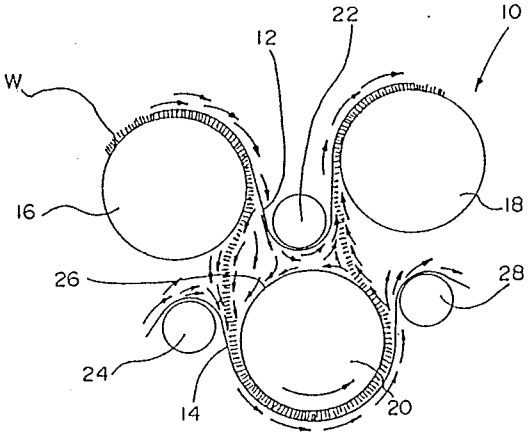
FIG. 1 PRIOR ART
FIG. 1 is a side elevational view of a prior art dryer section showing an upper and a lower felt with the web extending in open draw for a considerable distance between adjacent upper and lower dryer drums.

FIG. 1 is a side elevational view of a prior art dryer section generally designated 10 showing an upper felt 12 and a lower felt 14 with the web W extending in open draw for a considerable distance between adjacent upper dryer drums 16 and 18 and lower dryer drum 20 respectively. As shown in FIG. 1, the upper felt 12 does not extend around the lower drum 20 as in the "uni-run" type system but, rather, extends around an intermediate roll 22. Similarly, the lower felt 14 extends in sinusoidal configuration around lower intermediate roll 24 and then around the lower dryer drum 20 such that the web W is disposed between the lower felt 14 and the outer surface 26 of the lower dryer drum 20. The lower felt 14 then extends around a further lower intermediate roll 28.

Figure 2:
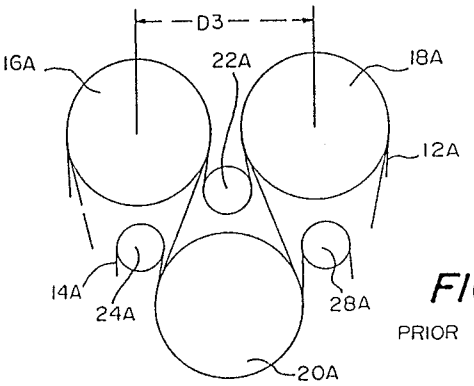
FIG. 2 PRIOR ART
FIG. 2 is a similar view to that shown in FIG. 1 but shows in the prior art arrangement of FIG. 1 how the upper dryer drums are brought close together in order to increase the number of dryer drums within a given available dryer section length.

FIG. 2 is a similar view to that shown in FIG. 1 but shows in the prior art arrangement of FIG. 1 how the upper dryer drums 16A and 18A are brought closer together in order to increase the number of dryer drums within a given available dryer section length.

Figure 3:
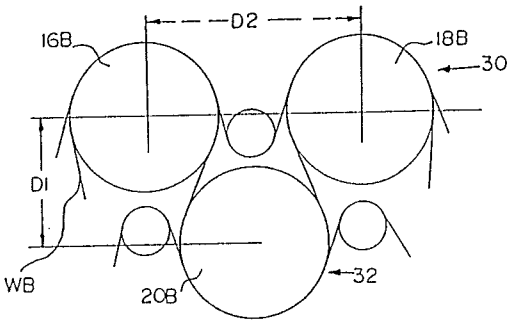
FIG. 3 PRIOR ART
FIG. 3 shows a so-called "squat type" dryer section in which the vertical distance between the upper and lower tier of dryer drums is reduced thereby reducing the unsupported distance travelled by the web between upper and lower dryer rums. This figure also shows that the distance between adjacent upper dryer drums is increased thereby reducing the number of dryer drums that may be provided within an available dryer section length.

FIG. 3 shows a so-called "squat type" dryer section in which the vertical distance D1 between the upper and lower tier 30 and 32 respectively of dryer drums 16B, 18B and 20B respectively is reduced thereby reducing the unsupported distance travelled by the web WB between the upper and lower dryer drums 16B and 20B respectively. FIG. 3 also shows that the distance D2 between adjacent upper dryer drums 16B and 18B is increased when compared with the distance D3 between upper drums 16A and 18A of FIG. 2 thereby reducing the number of dryer drums that may be provided within an available dryer section length.

Figure 4:
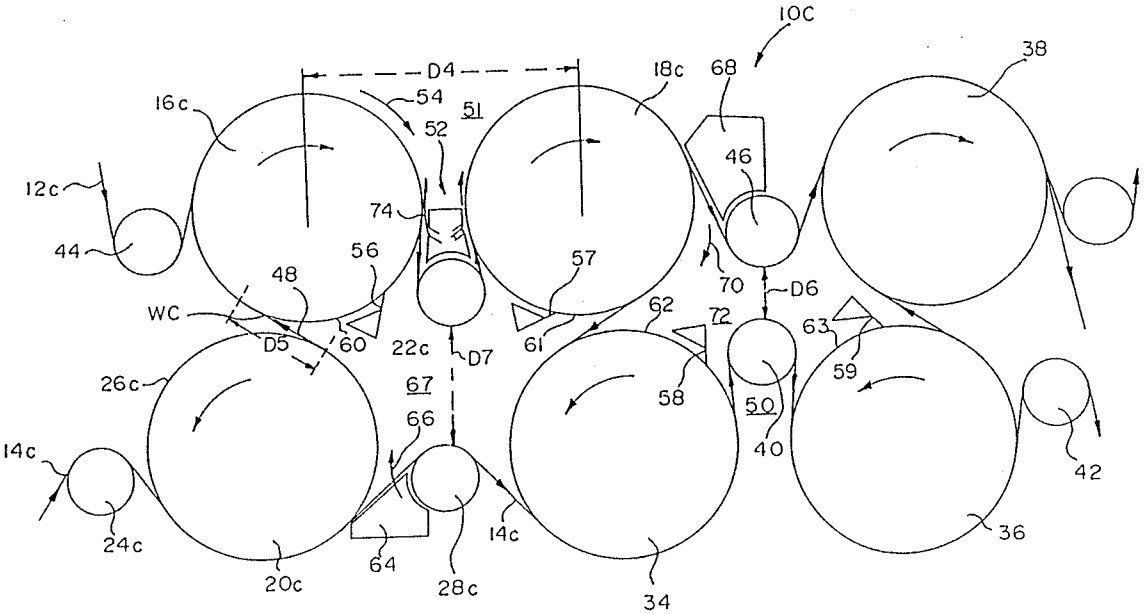
FIG. 4 is a sectional view of a dryer section apparatus according to the present invention showing the "squat type" arrangement but minimizing the distance between adjacent upper dryer drums and minimizing the distance that the unsupported web travels between adjacent upper and lower dryer drums.

FIG. 4 is a sectional view of a dryer section apparatus 10C according to the present invention. FIG. 4 shows the "squat type" arrangement but minimizes the distance D4 between adjacent upper dryer drums 16C and 18C. This arrangement also minimizes the distance D5 that the unsupported web WC travels between adjacent upper and lower dryer drums 16C and 20C respectively.

More specifically, the dryer section apparatus 10C shown in FIG. 4 is used for drying a web WC extending therethrough. The apparatus 10C includes a plurality of lower dryer drums 20C, 34 and 36 and a plurality of upper dryer drums 16C, 18C and 38. The apparatus 10C includes a lower felt 14C partially wrapping each lower dryer drum 20C, 34 and 36 of the plurality of lower dryer drums. A plurality of lower intermediate rolls 24C, 28C,40 and 42 are arranged such that each lower intermediate roll 24C, 28C,40 and 42 is disposed between adjacent dryer drums 20C, 34 and 36. The lower intermediate roll 28C is disposed between adjacent dryer drums 20C and 34 and the intermediate lower roll 40 is disposed between adjacent dryer drums 34 and 36 respectively. Each alternate lower intermediate roll 40 guides both the web WC and the lower felt 14C. An upper felt 12C partially wraps each upper dryer drum 16C, 18C and 38 of the plurality of upper dryer drums. A plurality of upper intermediate rolls 44,22C and 46 is arranged such that each upper intermediate roll 44, 22C and 46 is disposed between adjacent upper dryer drums. Upper roll 22C is disposed between dryer drums 16C and 18C and upper intermediate roll 46 is disposed between adjacent upper dryer drums 18C and 38 respectively. Each alternate upper intermediate roll such as roll 22C guides both the web WC and the upper felt 12C so that the web WC is transferred in open draw 48 between adjacent lower and upper dryer drums 20C and 16 respectively thereby minimizing the length D5 of the open draw 48 and inhibiting web flutter during transfer of the web between upper and lower dryer drums.

The dryer section apparatus 10C is arranged such that the lower felt 14C presses the web into physical contact with the lower dryer drums 20C, 34 and 36 such that when the lower dryer drums 20C, 34 and 36 are heated, the web WC pressed against the lower dryer drums 20C, 34 and 36 is dried. The lower felt 14C extends in sinusoidal configuration between each adjacent lower dryer drum 20C, 34 and 36 and lower intermediate rolls 24C, 28C, 40 and 42.

Alternate lower intermediate roll 40 is disposed adjacent to the upper intermediate roll 46 which is partially wrapped by only the upper felt 12C. Each alternate lower intermediate roll of rolls 24C, 28C, 40 and 42 is a vacuum roll.

The lower intermediate roll 40 which guides both the web WC and the lower felt 14C is disposed at a first distance D6 relative to the upper intermediate roll 46 which is partially wrapped by only the upper felt 12C. Each of the lower intermediate rolls such as 28C which is partially wrapped by the lower felt 14C only is disposed a second distance D7 relative to an adjacent upper intermediate roll 22C partially wrapped by both the web WC and the upper felt 12C. The second distance D7 is greater than the first distance D6.

Each lower intermediate roll such as 40 which is partially wrapped by the lower felt 14C and the web WC and each upper intermediate roll such as 22C which is partially wrapped by the upper felt 12C and the web WC defines pockets 50 and 51 respectively. A blow box generally designated 52 is disposed within the pocket 51 for ventilating the pocket 51 and for removing boundary air indicated by the arrow 54 entering into the pocket 51.

The upper felt 12C presses the web WC into physical contact with the upper dryer drums 16C, 18C and 38 such that when the upper dryer drums 16C, 18C and 38 are heated, the web WC pressed against the upper dryer drums is dried. The upper felt 12C extends in sinusoidal configuration between each adjacent upper dryer drum 16C, 18C and 38 and upper intermediate rolls 44, 22C and 46.

Each alternate upper intermediate roll such as 22C which guides both the web WC and the upper felt 12C is disposed adjacent to a lower intermediate roll 28C which is partially wrapped by only the lower felt 14C. Each of the alternate upper rolls such as 22C is a vacuum roll.

The dryer section apparatus 10C includes a plurality of doctor blades 56, 57, 58 and 59. Each blade 56 to 59 of the plurality of blades, cooperates with a corresponding dryer drum 16C, 18C, 34 and 36 of the upper and lower dryer drums such that each blade 56 to 59 contacts an unwrapped surface 60, 61, 62 and 63 respectively of each drum 16C, 18C, 34 and 36. The blades 56 to 59 assist in stabilizing the web WC by restricting the influence of external air flows. Furthermore, the blades 56 to 59 assist in directing a tail (not shown) of the web during threading of the apparatus without the use ropes.

As shown in FIG. 4, the apparatus 10C also includes a duct 64 disposed adjacent to each lower intermediate roll such as 28C partially wrapped only by the lower felt 14C. The duct 64 blows air (shown by the arrow 66) through the lower felt 14C for ventilating the adjacent dryer pocket 50 defined between the upper and the lower felts 12C and 14C respectively. The apparatus 10C also includes ventilating means 68 disposed adjacent to each upper intermediate roll such as 18C partially wrapped only by the upper felt 12C. The ventilating means 68 blows air (as shown by the arrow 70) through the upper felt 12C for ventilating air from an adjacent dryer pocket 72 defined between the upper and the lower felts 12C and 14C respectively.

In an alternative embodiment of the present invention, the intermediate vacuum rolls are replaced by grooved rolls.

Figure 5:
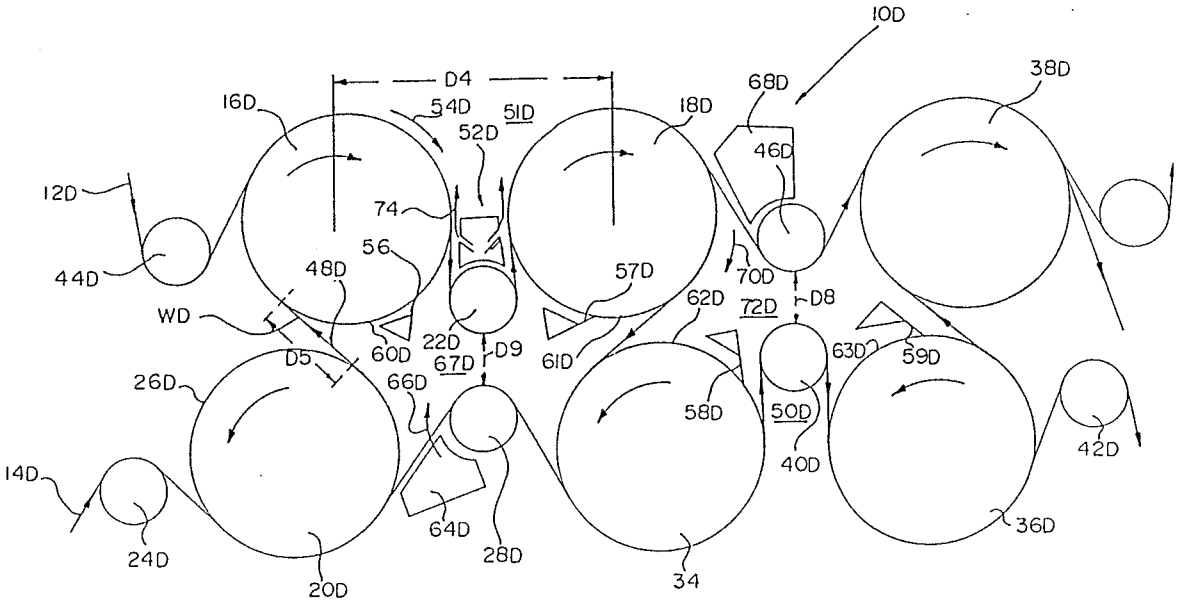
FIG. 5 is a similar view to that shown in FIG. 4 but shows the distance D6 as being the same as the distance D7.

FIG. 5 is a side-elevational view of a dryer section apparatus which is the same as the dryer apparatus shown in FIG. 4 except in that the distances D8 and D9 are the same whereas in the arrangement of FIG. 4, D7 is greater than D6. By this arrangement, the felt wrap on dryers 20D and 34D is increased.

In operation of the dryer section apparatus 10C when threading the apparatus, a tail (not shown) of the web WC is guided between the lower felt 14C and the lower dryer drum 20C. The web is heated by direct contact with the outer surface 26C of the lower dryer drum 20C and passes in a short open draw D5 towards and around upper dryer drum 16C with the web WC being disposed between the upper felt 12C and the outer surface of the dryer drum 16C. The combined felt 12C and web WC extend around upper intermediate roll 22C so that the felt and web 12C and WC respectively together extend around the upper dryer drum 18C. The blow box 52 blows a curtain of air in a direction as shown by the arrow 74 such that any boundary air 54 entrained by the drum 16C is directed away from entry into the pocket 51. The upper felt 12C after partially wrapping the drum 18C continues around upper intermediate roll 46 while the web WC continues travelling with the drum 18C and is guided by aid of the doctor 57 into contact with the outer surface of the lower dryer drum 34. The tail is directed between the lower felt 14C and the drum 34 and the felt 14C and the tail of the web extend together around lower intermediate roll 40 and thereafter around drum 36. The tail of the web in open draw extends towards and around upper drum 38 between the drum 38 and the upper felt 12C while the lower felt 14C extends around a further lower intermediate roll 42.

When the web has been threaded, the rotational speed of the drums is increased to operational speed and it will be appreciated that the web extends around each of the dryer drums 20C, 16C, 18C, 34, 36 and 38 in intimate contact with the heated surfaces thereof for a considerable portion of the circumference of each dryer drum. Furthermore, the distance D5 that the web extends in open draw between adjacent upper and lower dryer drums is minimal thereby inhibiting the possibility of sheet flutter between adjacent dryer drums. Additionally, because of the aforementioned configuration, the number of upper and lower dryer drums that may be incorporated within a given dryer section length is increased due to the wrapping of both the web and felt around each alternate intermediate roll.

The present invention provides a dryer section apparatus of compact configuration that enables the heating capability of each dryer drum within the section to be maximized. The arrangement also provides sufficient room for the inclusion therein of a doctor blade adjacent each individual dryer drum. Furthermore, the distance travelled by the unsupported web between adjacent dryer drums is minimized thereby reducing sheet flutter considerably.

What is claimed is:

1. A dryer section apparatus for drying a web extending therethrough, said apparatus having a plurality of lower dryer drums and a plurality of upper dryer drums, said apparatus comprising:

a lower felt partially wrapping each lower dryer drum of the plurality of lower dryer drums;

a plurality of lower intermediate rolls, each lower intermediate roll being disposed between adjacent lower dryer drums such that only each alternate lower intermediate roll guides both the web and said lower felt;

an upper felt partially wrapping each upper dryer drum of the plurality of upper dryer drums; a plurality of upper intermediate rolls, each upper intermediate roll being disposed between adjacent upper dryer drums such that only each alternate upper intermediate roll guides both the web and said upper felt so that the web is transferred in open draw between adjacent upper and lower dryer drums thereby minimizing the length of said open draw and inhibiting web flutter during transfer between upper and lower dryer drums;

each alternate lower intermediate roll which guides both the web and said lower felt being disposed adjacent to an upper intermediate roll which is partially wrapped by only said upper felt, each of said alternate lower intermediate rolls being a vacuum roll; and said lower intermediate roll which guides both the web and said lower felt being disposed at a first distance relative to said upper intermediate roll which is partially wrapped by only said upper felt, each of said lower intermediate rolls which are partially wrapped by said lower felt only being disposed a second distance relative to adjacent upper intermediate rolls partially wrapped by both the web and said upper felt, said second distance being greater than said first distance.

2. A dryer section apparatus for drying a web extending therethrough, said apparatus having a plurality of lower dryer drums and a plurality of upper dryer drums, said apparatus comprising:

a lower felt partially wrapping each lower dryer drum of the plurality of lower dryer drums;

a plurality of lower intermediate rolls, each lower intermediate roll being disposed between adjacent lower dryer drums such that only each alternate lower intermediate roll quides both the web and said lower felt;

an upper felt partially wrapping each upper dryer drum of the plurality of upper dryer drums;

a plurality of upper intermediate rolls, each upper intermediate roll being disposed between adjacent upper dryer drums such that only each alternate upper intermediate roll guides both the web and said upper felt so that the web is transferred in open draw between adjacent upper and lower dryer drums thereby minimizing the length of said open draw and inhibiting web flutter during transfer between upper and lower dryer drums;

each alternate lower intermediate roll which guides both the web and said lower felt being disposed adjacent to an upper intermediate roll which is partially wrapped by only said upper felt, each of said alternate lower intermediate rolls being a vacuum roll; and said lower intermediate roll which guides both the web and said lower felt being disposed to a first distance relative to said upper intermediate roll which is partially wrapped by only said upper felt, each of said lower intermediate rolls which are partially wrapped by said lower felt only being disposed a second distance relative to adjacent upper intermediate rolls partially wrapped by both the web and said upper felt, said second distance being the same as said first distance.

3. A dryer section apparatus as set forth in claim 1 wherein said lower felt presses the web into physical contact with the lower dryer drums such that when the lower dryer drums are heated, the web pressed against the lower dryer drums is dried, said lower felt extending in sinusoidal configuration between each adjacent lower dryer drum and lower intermediate roll.

4. A dryer section apparatus as set forth in claim 1 wherein each alternate lower intermediate roll which guides both the web and said lower felt is disposed adjacent to an upper intermediate roll which is partially wrapped by only said upper felt, each of said alternate lower intermediate rolls being a vacuum roll.

5. A dryer section apparatus as set forth in claim 1 wherein each of said alternate lower rolls is a grooved roll.

6. A dryer section apparatus as set forth in claim 1 wherein each lower intermediate roll which is partially wrapped by said lower felt and the web and each upper intermediate roll which is partially wrapped by said upper felt and the web defines a pocket.

7. A dryer section apparatus as set forth in claim 6 further including:

a blow box disposed within each of said pockets for ventilating each of said pockets and for removing boundary air entering into said pocket.

8. A dryer section apparatus as set forth in claim 1 wherein said upper felt presses the web into physical contact with the upper dryer drums such that when the upper dryer drums are heated, the web pressed against the upper dryer drums is dried, said upper felt extending in sinusoidal configuration between each adjacent upper dryer drum and upper intermediate roll.

9. A dryer section apparatus as set forth in claim 1 wherein each alternate upper intermediate roll which guides both the web and said upper felt is disposed adjacent to a lower intermediate roll which is partially wrapped by only said lower felt, each of said alternate upper rolls being a vacuum roll.

10. A dryer section apparatus as set forth in claim 1 further including:

a plurality of doctor blades, each blade of said plurality of blades cooperating with a corresponding dryer drum of the upper and lower dryer drums such that each blade contacts an unwrapped surface of each respective drum.

11. A dryer section apparatus as set forth in claim 10 wherein said blades assist in stabilizing the web by restricting the influence of external air flows, said blades also assisting in directing a tail of the web during threading of the apparatus without the use of ropes.

12. A dryer section apparatus as set forth in claim 1 further including:

a duct disposed adjacent to each lower intermediate roll partially wrapped only by said lower felt, said duct blowing air through said lower felt for ventilating an adjacent dryer pocket defined between said upper and lower felts.

13. A dryer section apparatus as set forth in claim 1 further including:

ventilating means disposed adjacent to each upper intermediate roll partially wrapped only by said upper felt, said ventilating means blowing air through said upper felt for ventilating air from an adjacent dryer pocket defined between said upper and lower felts.

* * * * *